US012446666B2

(12) United States Patent
Phi

(10) Patent No.: US 12,446,666 B2
(45) Date of Patent: Oct. 21, 2025

(54) REPLACEABLE BELT BUCKLE DECORATIVE COVER

(71) Applicant: Textron Aviation Inc., Wichita, KS (US)

(72) Inventor: Thang Chien Phi, Wichita, KS (US)

(73) Assignee: Textron Innovations Inc., Providence, RI (US)

( * ) Notice: Subject to any disclaimer, the term of this patent is extended or adjusted under 35 U.S.C. 154(b) by 158 days.

(21) Appl. No.: 17/870,366

(22) Filed: Jul. 21, 2022

(65) Prior Publication Data

US 2023/0048192 A1 Feb. 16, 2023

Related U.S. Application Data

(60) Provisional application No. 63/232,327, filed on Aug. 12, 2021.

(51) Int. Cl.
*A44B 11/25* (2006.01)

(52) U.S. Cl.
CPC ..... *A44B 11/2576* (2013.01)

(58) Field of Classification Search
CPC ..... A44B 11/2576; A44B 11/2507; A44B 11/2511; A44B 11/2515; A44B 11/2523; A44B 11/2519; A44B 11/2573; A44B 11/2503
See application file for complete search history.

(56) References Cited

U.S. PATENT DOCUMENTS

| | | | | |
|---|---|---|---|---|
| 3,522,640 | A * | 8/1970 | Lohr | A44B 11/2511 24/656 |
| 4,674,303 | A * | 6/1987 | Salcone, II | A44B 11/2576 220/210 |
| 4,731,912 | A | 3/1988 | Boriskie et al. | |
| 4,901,407 | A * | 2/1990 | Pandola | A44B 11/2576 24/DIG. 30 |
| 5,307,544 | A | 5/1994 | Quarberg et al. | |
| 5,416,957 | A * | 5/1995 | Renzi, Sr. | A44B 11/2576 24/579.11 |
| 6,988,297 | B2 * | 1/2006 | Willard | A44B 11/2576 24/633 |
| 7,243,403 | B2 * | 7/2007 | Hoffman | A44B 11/2576 24/633 |
| 2007/0289111 | A1 | 12/2007 | Mandarino et al. | |
| 2020/0275743 | A1 * | 9/2020 | Heath | A44B 11/2576 |

FOREIGN PATENT DOCUMENTS

| | | | | |
|---|---|---|---|---|
| WO | WO-8401275 | A1 * | 4/1984 | |
| WO | WO-9320728 | A1 * | 10/1993 | A44B 11/2573 |

* cited by examiner

*Primary Examiner* — Milton Nelson, Jr.
(74) *Attorney, Agent, or Firm* — Avek IP, LLC

(57) ABSTRACT

A non-structural seat belt buckle cover is disclosed. The seat belt buckle cover may be used to protect seat belt buckles used on aircraft from damage. The seat belt buckle cover may comprise a top cover and a bottom cover that are coupled together to enclose a seat belt buckle. The seat belt buckle cover may comprise various openings to provide a user access to portions of the seat belt buckle.

14 Claims, 4 Drawing Sheets

REPLACEABLE BELT BUCKLE DECORATIVE COVER

CROSS-REFERENCE TO RELATED APPLICATIONS

This application claims the benefit of U.S. Provisional Application No. 63/232,327 entitled "Replaceable Belt Buckle Decorative Cover" and filed on Aug. 12, 2021, the entirety of which is hereby incorporated by reference.

BACKGROUND OF THE INVENTION

1. Field

The disclosed embodiments relate generally to the field of seat belt buckle covers. More specifically, the embodiments relate to a non-structural belt buckle cover for protecting an airplane seat belt buckle.

2. Description of the Related Art

Many different types of seat belt buckle covers have been described in the prior art. For example, U.S. Pat. No. 4,731,912 to Boriskie et al. discloses a hinged seat belt buckle release guard that forms a box around a buckle to prevent children from accidentally unbuckling the buckle. U.S. Patent Application Publication No. 2007/0289111 to Mandarino et al. describes a security cover for a restraint buckle comprising two halves that are latched together to enclose the restraint buckle. U.S. Pat. No. 5,307,544 to Quarberg et al. discloses a box-like structure that encloses a buckle and has a key to lock and unlock the buckle cover.

SUMMARY

In some aspects, the techniques described herein relate to a non-structural seat belt buckle cover, including: a top cover configured to partially enclose a top portion of a seat belt buckle, the top cover including: a top face configured to protect at least a portion of a seat belt buckle; a front face including two shoulders with an opening therebetween, wherein the two shoulders are substantially parallel with each other, and wherein the opening is configured to receive a seat belt buckle tongue, wherein the seat belt buckle tongue is configured for releasably connecting with the seat belt buckle; a back face including a cavity configured to receive a seat belt, the seat belt being mechanically coupled with the seat belt buckle; and two opposing side walls, the side walls being substantially perpendicular to the top face and to the back face; a bottom cover configured to abut the top cover when the seat belt buckle is enclosed between the top cover and the bottom cover; and at least one fastener configured to secure the top cover with the bottom cover.

In some aspects, the techniques described herein relate to a non-structural seat belt buckle cover, including: a top cover, including: a top wall including a first opening for providing access to a release of a seat belt buckle received within the non-structural seat belt buckle cover; a first side wall and a second side wall extending substantially perpendicular from the top wall; and a back wall substantially perpendicular to the top wall, the first side wall, and the second side wall, the back wall including a second opening for receiving a seat belt therein, the seat belt mechanically coupled to the seat belt buckle; a bottom cover having a top face that abuts the first side wall, the second side wall, and the back wall when the bottom cover is coupled to the top cover; and at least one fastener for coupling the top cover to the bottom cover.

In some aspects, the techniques described herein relate to a non-structural seat belt buckle cover, including: a top cover configured to at least partially enclose a seat belt buckle, the top cover including at least one opening for providing a seat belt wearer access to a seat belt buckle; and a bottom cover configured to at least partially enclose the seat belt buckle, the bottom cover including a top face abutting a bottom face of the top cover; and at least one connecter for coupling the top cover to the bottom cover.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages will be apparent from the following detailed description of the embodiments and the accompanying drawing figures.

BRIEF DESCRIPTION OF THE SEVERAL VIEWS OF THE DRAWINGS

Illustrative embodiments are described in detail below with reference to the attached drawing figures, which are incorporated by reference herein and wherein.

Figure 1:
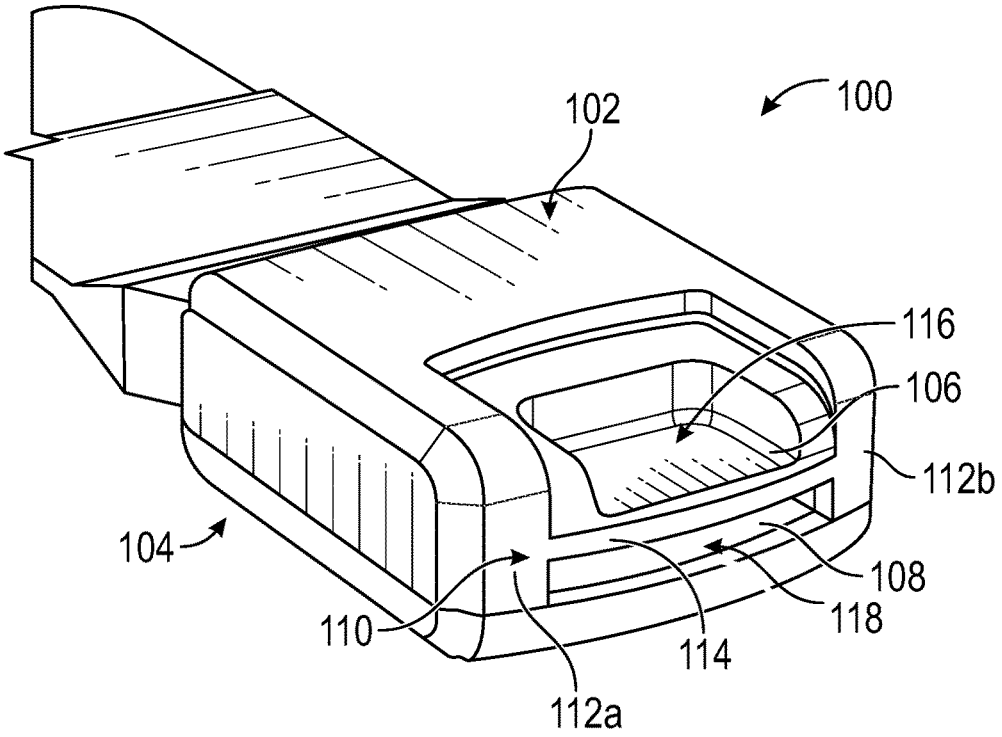
FIG. 1 depicts a perspective view of the seat belt buckle cover enclosed on a seat belt buckle.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

In the United States, seat belt buckles on airplanes are subject to rules and regulations set forth by the Federal Aviation Administration (FAA). Other countries and governing bodies have similar regulatory bodies for regulating seat belt buckles, such as the European Aviation Safety Administration (EASA) in Europe. The FAA, EASA, and other similar regulatory bodies consider the seat belt buckle to be a structural component of the airplane. As such, when the seat belt buckle is damaged, it must be replaced or repaired to ensure the seat belt buckle complies with the rules and regulations. Replacing and repairing seat belt buckles can be an expensive and time-consuming task. When a seat belt buckle is damaged, the entire seat belt assembly may need to be replaced. Additionally, extra inventory may be required to be kept on hand in the event a seat belt buckle is damaged and needs to be replaced. The disclosed system is a non-structural cover for a seat belt buckle cover that is not subject to the certification requirements of a governing body and protects the seat belt buckle from damage.

Embodiments disclosed herein provide a seat belt buckle cover for use with aircraft seat belts; however, the seat belt buckle cover may be used to cover seat belt buckles in a variety of vehicles including, but not limited to, automobiles, boats, trains, roller coasters, and the like.

Embodiments of the present disclosure provide a non-structural seat belt buckle cover that may be replaced on-site when damaged and may avoid the need to perform costly repair or replacement of damaged seat belt buckles and re-certification of the buckles.

FIG. 1 depicts a front view of a seat belt buckle cover 100. Seat belt buckle cover 100 may comprise aluminum or magnesium or another like metal that is lightweight and plateable. Seat belt buckle cover 100 may comprise a top cover 102 and a bottom cover 104 (see also FIGS. 3-5) that are configured to form an enclosure over a seat belt buckle when enclosed. In embodiments, top cover 102 and bottom cover 104 form an enclosure much like a clam shell when closed. Top cover 102 may be configured to enclose the seat belt buckle while still allowing for a seat belt to be inserted and removed easily by a user. In some embodiments, top cover 102 is substantially rectangular in shape. Top cover 102 may comprise a first opening 116 configured for providing access by a user to a release 106 of the seat belt buckle. Release 106 is configured to be depressed or otherwise actuated to allow the wearer to eject a seat belt buckle tongue (see FIG. 2) from a receiver 108, as further described below.

Figure 4:
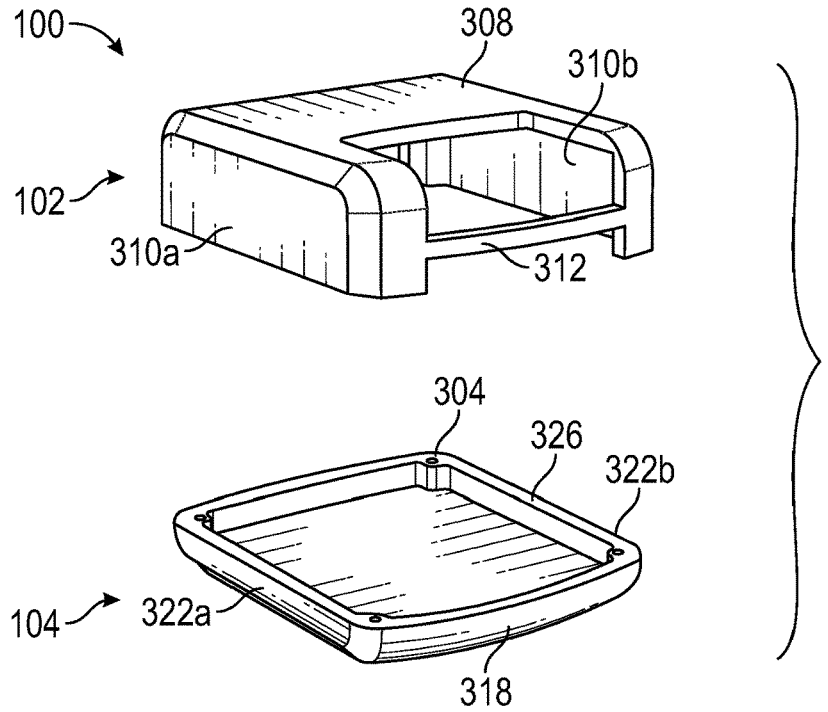
FIG. 4 depicts a second exploded view of the seat belt buckle cover.

A top face of top cover 102 may have a curved or substantially flat face with an opening at a front end of seat belt buckle cover 100 (see e.g., FIG. 4). The opening may be roughly the same size or slightly larger than release 106. In some embodiments, top cover 102 is configured with a smaller opening that only allows a portion of release 106 to be accessible by the user. Such an arrangement may provide for added protection of release 106. Receiver 108 is configured to receive a seat belt tongue and includes internal mechanisms (not shown) to latch the seat belt tongue in place, thereby securing the seat belt for protecting the user in the event of turbulence or the like.

In embodiments, front face 110 of top cover 102 has a substantially H-shaped facade. In other words, front face 110 may have a first shoulder 112*a* and a second shoulder 112*b* aligned vertically with each other, defining a gap therebetween, and a connecting member 114 arranged transversely between the shoulders 112*a*, 112*b*, thereby forming a shape that resembles the letter "H". In some embodiments, connecting member 114 is substantially horizontal. As depicted in FIG. 1, first opening 116 and a second opening 118 are arranged above and below connecting member 114, respectively. Second opening 118 may be formed when top cover 102 and bottom cover 104 are assembled together. Connecting member 114 may help to distinguish release 106 from receiver 108 to aid users in correctly using the seat belt.

While seat belt buckle cover 100 will be described herein with respect to the H-shaped seat belt buckle cover 100, embodiments are not limited to that particular geometry. Broadly, seat belt buckle cover 100 may take any shape provided the shape protects the seat belt from damage while still allowing a user to access release 106 and receiver 108 to operate the seat belt. In some embodiments, seat belt buckle cover 100 does not include connecting member 114, and instead, one large opening for receiving both release 106 and receiver 108 is provided between the shoulders 112*a*, 112*b*. Release 106 may be a different color than seat belt buckle cover 100, such as red, to help distinguish release 106 from seat belt buckle cover 100 and receiver 108. Alternatively, release 106 may be on a top face of the seat belt buckle. In such an embodiment, the top face of top cover 102 may comprise an opening allowing access to release 106. In some such embodiments, first opening 116 may be omitted (e.g., front face 110 would extend between shoulders 112*a*, 112*b* and include connecting member 114) and only second opening 118 would remain for allowing access to receiver 108. As illustrated, first opening 116 is formed from an opening in both the top face and the front face of top cover 102. However, in some embodiments, first opening 116 may only be formed from an opening in the front face of top cover 102 such that the top face of top cover 102 has no opening for accessing the seat belt buckle.

Bottom cover 104 may be configured to connect to top cover 102 to enclose the seat belt buckle. Bottom cover 104 and top cover 102 may be connected with a mechanical fastener or the like as will be discussed in more detail below in connection with FIG. 3. Bottom cover 104 and top cover 102 may have comparable length and width such that top cover 102 and bottom cover 104 are flush when fastened together. In embodiments, bottom cover 104 may be shorter in height than top cover 102. Alternatively, in some embodiments, top cover 102 and bottom cover 104 have the same height. In some embodiments, second opening 118 is included in bottom cover 104 rather than in top cover 102 for receiving a seat belt buckle into receiver 108.

Figure 2:
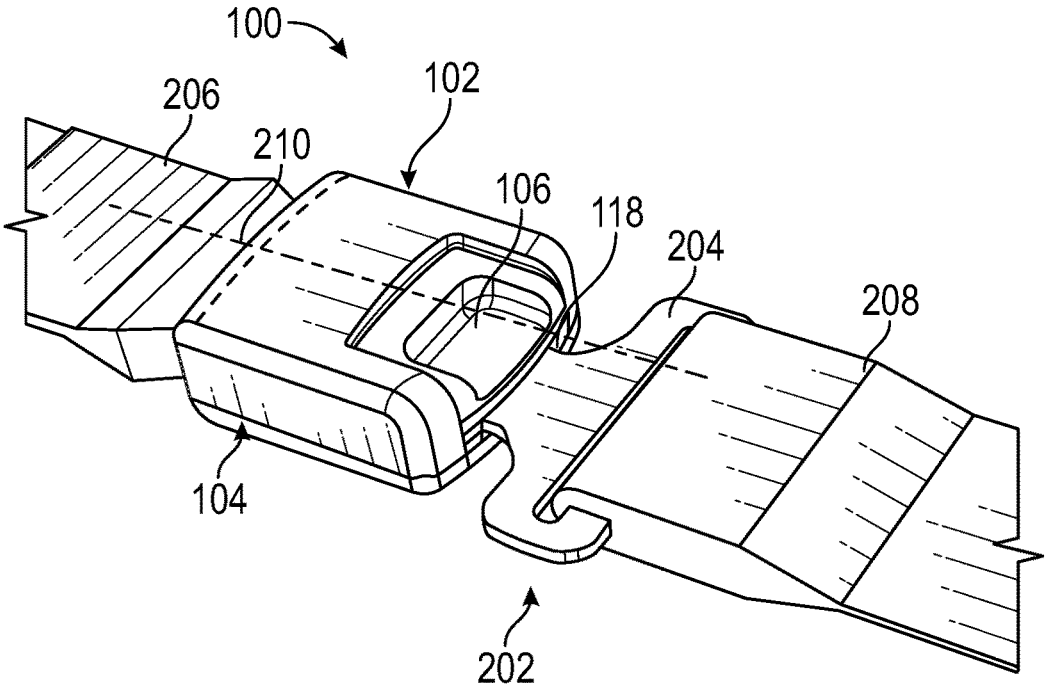
FIG. 2 depicts a perspective view of the seat belt buckle cover enclosed on a seat belt buckle with a seat belt inserted.

FIG. 2 depicts seat belt buckle cover 100 with seat belt 202 inserted into receiver 108. As shown in FIG. 2, seat belt 202 comprises a seat belt buckle tongue 204, a first strap 206 and a second strap 208. First strap 206 may be connected to the seat belt buckle while second strap 208 may be connected to seat belt buckle tongue 204. Seat belt buckle tongue 204 may releasably connect with receiver 108 such that when release 106 is actuated, seat belt buckle tongue 204 releases from the seat belt. Because of the substantially H-shaped design formed by top cover 102, the user may easily insert and eject seat belt 202 while seat belt buckle cover 100 provides protection for the seat belt buckle. As shown, seat belt 202 is configured to be placed across the lap of the user; however, in some embodiments, seat belt 202 is configured to be a three-point, four-point, five-point, or six-point seat belt or the like, and seat belt buckle cover 100 may be configured to enclose the seat belt buckle in each of the aforementioned arrangements. In embodiments, top cover 102 is symmetrical about a longitudinal axis 210, depicted as a dashed line in FIG. 2, that extends longitudinally along seat belt buckle cover 100. Likewise, in embodiments, bottom cover 104 is symmetrical about longitudinal axis 210.

Figure 3:
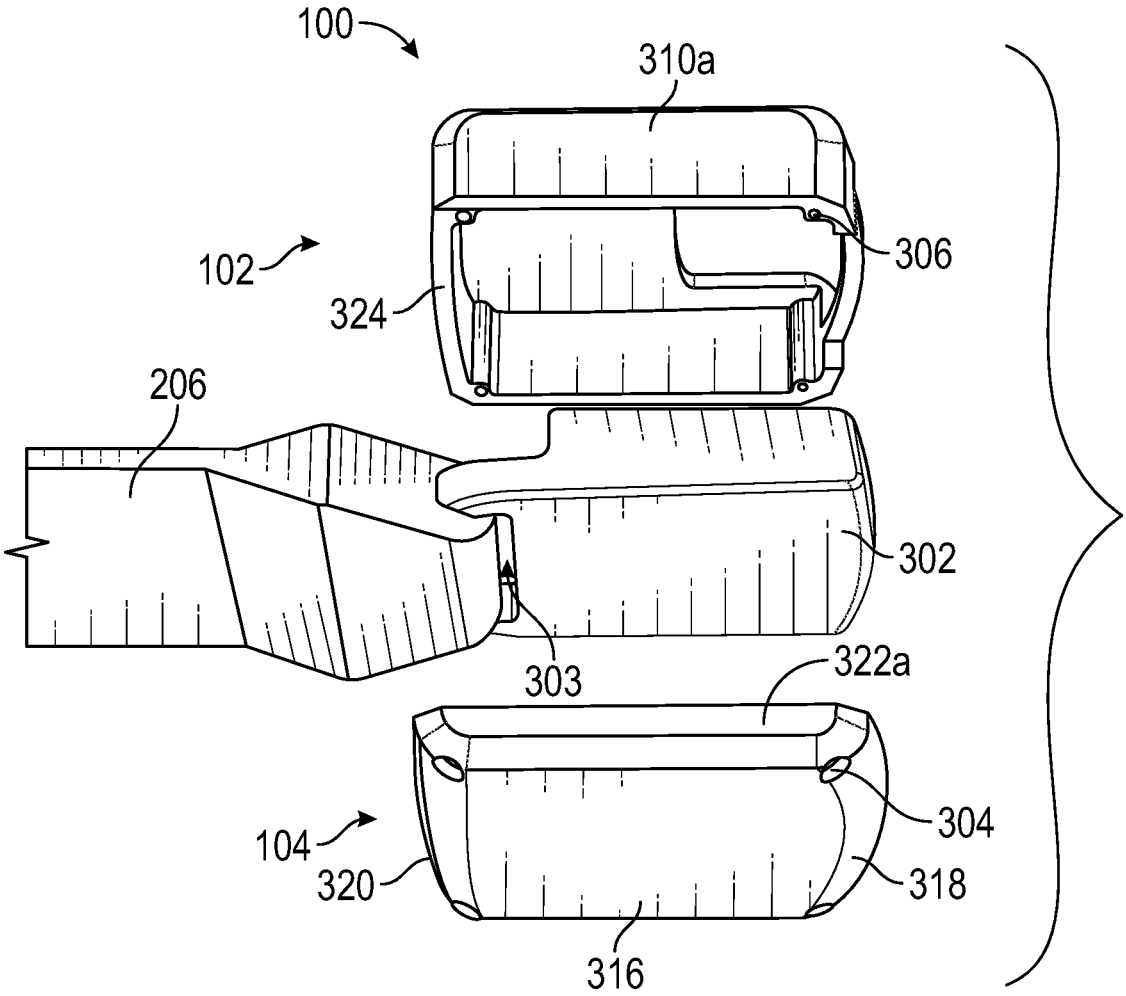
FIG. 3 depicts an exploded view of the seat belt buckle cover and the seat belt buckle.
Figure 5:
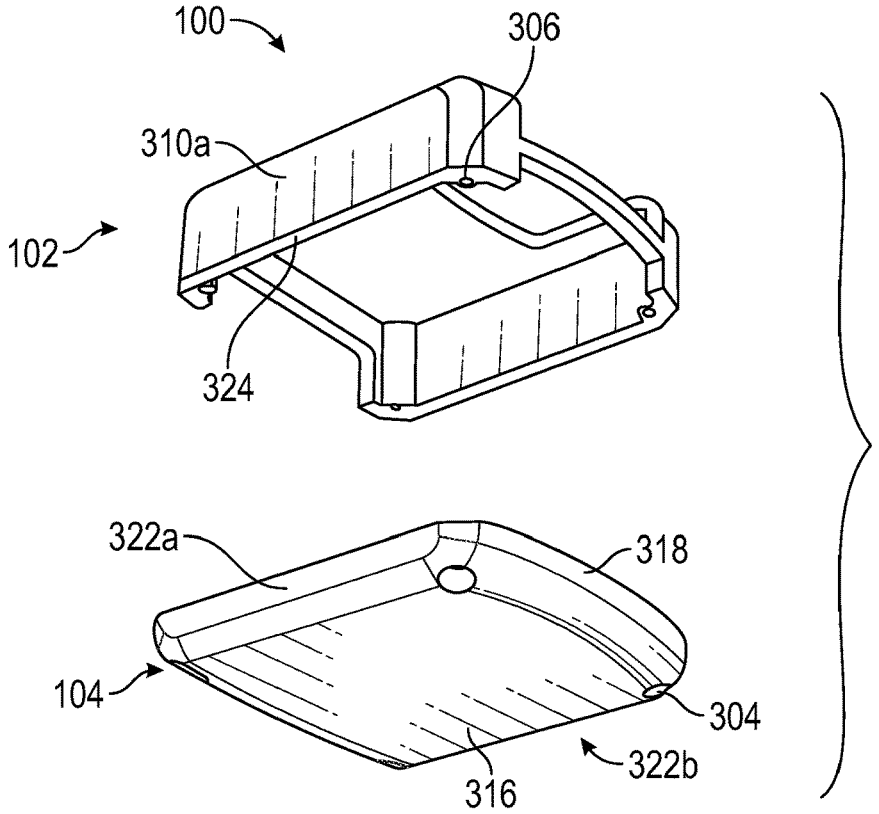
FIG. 5 depicts a third exploded view of the seat belt buckle cover.

FIGS. 3-5 depict an exploded view of seat belt buckle cover 100 in which top cover 102 and bottom cover 104 have been separated from a seat belt buckle 302. In FIGS. 4 and 5, seat belt buckle 302 has been omitted for clarity. Seat belt buckle 302 may be a standard seat belt buckle as seen on common aircraft that meets the certification criteria set forth by a governing body, such as the FAA. Seat belt buckle 302 may be a push-button buckle, as depicted, or a latch-type buckle as is known in the art. As illustrated in FIG. 3, first strap 206 of seat belt 202 is mechanically coupled to seat belt buckle 302. Seat belt 202 may be coupled to seat belt buckle 302 using various coupling means. For example, first strap 206 may be looped through opening 303 on seat belt buckle 302 and then sewn to prevent first strap 206 from uncoupling with seat belt buckle 302. In embodiments, bottom cover 104 may comprise bottom fastener holes 304, and top cover 102 may comprise top fastener holes 306 (also referred to hereinafter collectively as fastener holes 304 and 306) corresponding to bottom fastener holes 304. Bottom fastener holes 304 and top fastener holes 306 may align such that a mechanical fastener may be inserted through bottom fastener holes 304 and into the corresponding top fastener holes 306 to secure top cover 102 and bottom cover 104 together. In some embodiments, the mechanical fastener may be a screw, and one or both of bottom fastener holes 304 and top fastener holes 306 are threaded to receive the screw. In other embodiments, the fastener may be a bolt or a buckle. Broadly speaking, any mechanical fastener now known or later developed is within the scope of the systems described herein. It will be appreciated that top cover 102 may be secured to bottom cover 104 without the use of a mechanical fastener. For example, top cover 102 and bottom cover 104 may be formed to snap fit with one another. In some embodiments, adhesives may be used for coupling. As another example, top cover 102 and bottom cover 104 may be magnetically coupled.

As depicted, top cover 102 and bottom cover 104 each comprise four fastener holes 304 and 306; however, top cover 102 and bottom cover 104 may comprise any number of fastener holes 304 and 306 without departing from the scope hereof. For example, it may be desirable to reduce the total part count of seat belt buckle cover 100. As such, top cover 102 and bottom cover 104 may instead comprise two each of fastener holes 304 and 306 configured to receive two mechanical fasteners. In some such embodiments, the size of the mechanical fasteners and fastener holes 304 and 306 may increase, accordingly, to compensate for any decrease in the number of fasteners. The positioning of bottom fastener holes 304 and top fastener holes 306 may also change in various embodiments. For example, if the number of fastener holes 304 and 306 are decreased from four to two, it may be desired to move fastener holes 304 and 306 towards the middle of bottom cover 104 and top cover 102, respectively. This positioning may better secure seat belt buckle cover 100 than if the two fastener holes were left at either end of seat belt buckle cover 100. Alternatively, the two fastener holes 304 and 306 may be positioned at opposing corners of bottom cover 104 and top cover 102. In other embodiments, the fasteners may be configured to be inserted through the back and front faces of top cover 102 and bottom cover 104. The fasteners may comprise a material such as tool steel or stainless steel or the like. Broadly, any arrangement of fastener holes 304 and 306 to receive fasteners and secure seat belt buckle cover 100 is considered within the scope of the present disclosure.

In embodiments, top cover 102 and bottom cover 104 are shaped like an open-faced box and are substantially rectangular. More specifically, top cover 102 may comprise a top face 308 (see FIG. 4), first side wall 310*a* and second side wall 310*b*, a front face 312, and a back face 314 (see FIG. 6), but no bottom wall. Front face 312 and back face 314 may be substantially perpendicular to top face 308 and substantially parallel to one another. Likewise, side walls 310*a* and 310*b* of top cover 102 may be substantially perpendicular to each of top face 308, front face 312 and back face 314, and be substantially parallel to one another. Top cover 102 may comprise a cavity for receiving a seat belt buckle therein, as will be discussed with respect to FIG. 6.

In embodiments, bottom cover 104 has a similar arrangement to top cover 102. For example, bottom cover 104 may comprise a bottom face 316, a front face 318 and a back face 320, a first side wall 322*a*, and a second side wall 322*b*, but no top wall. First side wall 322*a* and second side wall 322*b* of bottom cover 104 may oppose each other. First side wall 322*a* and second side wall 322*b* may be substantially flat and extend substantially upwards to meet first and second side walls 310*a* and 310*b* of top cover 102. Front face 318 and back face 320 may be substantially perpendicular to bottom face 316 and extend substantially upwards. Front face 318 and back face 320 may be substantially parallel to each other. Bottom side walls 322*a* and 322*b* may also be substantially perpendicular to each of bottom face 316, front face 318 and back face 320, and may be substantially parallel to each other.

In some embodiments, first and second side walls 322*a* and 322*b* may comprise fillets and/or chamfers where first and second side walls 322*a* and 322*b* interface with bottom face 316, back face 320, and/or front face 318. The fillets and chamfers may be present to make seat belt buckle cover 100 more comfortable for users to wear and to prevent potential damage caused by sharp corners or edges. In some embodiments, first and second side walls 322*a* and 322*b* may be identical to one another. Likewise, first side wall 310*a* and second side wall 310*b* of top cover 102 may be chamfered and/or filleted where first and second side walls 310*a* and 310*b* interface with any of top face 308, front face 312, and/or back face 314 of top cover 102. First and second side walls 310*a* and 310*b* may be identical to each other in some embodiments and symmetrical with one another in other embodiments.

Also illustrated in FIGS. 3-5 are the inside face and walls of top cover 102. As best depicted in FIG. 5, top cover 102 is a thin-walled part forming a cavity for seat belt buckle 302 to be enclosed therein. Top cover 102 also comprises bottom face 324 that interfaces with top face 326 (see FIG. 4) of bottom cover 104. Bottom face 324 of top cover 102 and the top face 326 of bottom cover 104 may mirror and oppose one another such that when top cover 102 and bottom cover 104 are enclosed, the two faces are abutting one another. The two opposing faces 324 and 326 may also comprise through holes 304 and 306 as described above in corresponding locations for receiving the fasteners therein. In some embodiments, a locking washer or an adhesive such as LOCTITE® may be used to lock the fasteners in place. Once top cover 102 is fastened to bottom cover 104 via fasteners, bottom face 324 is flush against top face 326. In some embodiments, bottom face 324 and top face 326 may comprise an applied material designed to reduce wear from contact between the two abutting faces 324 and 326. For example, a piece of felt or other fabric may be applied.

Figure 6:
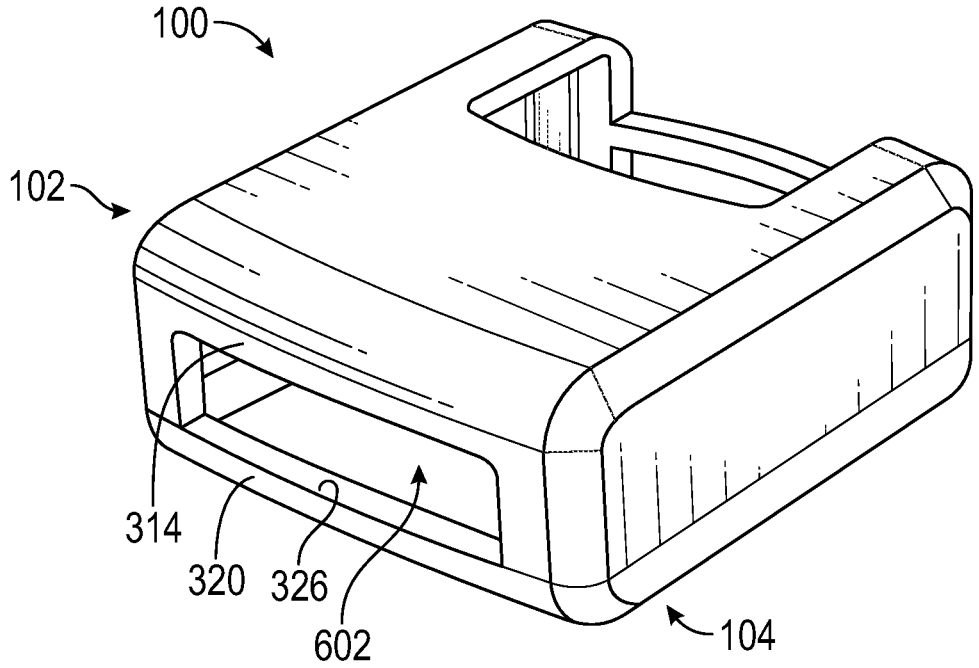
FIG. 6 depicts a perspective view of the seat belt buckle cover focusing on the back wall of the seat belt buckle cover.

Turning now to FIG. 6, a back perspective view of seat belt buckle cover 100 is illustrated. As depicted, top cover 102 and bottom cover 104, when enclosed and abutting, form cavity 602 for receiving seat belt buckle 302. In some embodiments, cavity 602 is formed entirely from the structure of back face 314 of top cover 102. In some embodiments, cavity 602 is formed partially from the structure of back face 314 and partially from back face 320 of bottom cover 104. In embodiments, seat belt buckle cover 100 only encloses seat belt buckle 302 but not any portion of seat belt 202. Alternatively, in some embodiments, a portion of seat belt 202 is also enclosed by seat belt buckle cover 100.

In embodiments, seat belt buckle cover 100 is sized to be larger than seat belt buckle 302 such that when top cover 102 and bottom cover 104 enclose seat belt buckle 302, no portion of seat belt buckle cover 100 is in contact with seat belt buckle 302. As such, any forces applied to seat belt buckle cover 100 are not transferred directly through seat belt buckle cover 100 and do not impact seat belt buckle 302. Alternatively, in some embodiments, seat belt buckle cover 100 is sized such that the inside walls of top cover 102 and bottom cover 104 are in contact with the external walls of seat belt buckle 302.

It will be appreciated that seat belt buckle cover 100 may take various configurations to provide a non-structural seat belt buckle cover that protects a structural seat belt to prevent damage thereto. For example, while a two-piece seat belt buckle cover 100 comprising a top cover 102 and bottom cover 104 has been discussed herein, it is contemplated that seat belt buckle cover 100 may be formed from more than two-pieces. For example, top cover 102 may be formed from two pieces that are coupled together and then coupled to top cover 102 to form seat belt buckle cover 100. Likewise, seat belt buckle cover 100 may instead by unitary. For example, seat belt buckle cover 100 could be a single molded piece configured to enclose seat belt buckle 302. As an example, a hinged, single piece seat belt buckle cover 100 may be used to enclose seat belt buckle 302. A single piece seat belt buckle cover 100 may be hinged at the interface between front face 110 of top cover 102 and front face 318 of bottom cover 104, for example. In some such embodiments, no fasteners are used to secure top cover 102 to bottom cover 104.

Many different arrangements of the various components depicted, as well as components not shown, are possible without departing from the spirit and scope of what is claimed herein. Embodiments have been described with the intent to be illustrative rather than restrictive. Alternative embodiments will become apparent to those skilled in the art that do not depart from what is disclosed. A skilled artisan may develop alternative means of implementing the aforementioned improvements without departing from what is claimed.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A replaceable seat belt buckle cover, comprising:

a top cover configured to partially enclose a top portion of a seat belt buckle, the top cover comprising:

a top face configured to protect at least a portion of a seat belt buckle;

a front face comprising two shoulders with a first opening therebetween, wherein the two shoulders are substantially parallel with each other, and wherein the first opening is configured to receive a seat belt buckle tongue, wherein the seat belt buckle tongue is configured for releasably connecting with the seat belt buckle;

a connecting member extending between the two shoulders, wherein the connecting member defines a second opening of the front face;

a back face comprising a cavity configured to receive a seat belt, the seat belt being mechanically coupled with the seat belt buckle; and two opposing side walls, the side walls being substantially perpendicular to the top face and to the back face;

a bottom cover configured to abut the top cover when the seat belt buckle is enclosed between the top cover and the bottom cover; and at least one fastener configured to secure the top cover with the bottom cover; and wherein the second opening is of a sufficient size that a user can access a seat belt buckle release using a finger, while the top cover is secured to the bottom cover.

2. The replaceable seat belt buckle cover of claim 1, wherein the top cover and the bottom cover are symmetrical about a longitudinal axis extending longitudinally along the replaceable seat belt buckle cover.

3. The replaceable seat belt buckle cover of claim 1, wherein a material of the replaceable seat belt buckle cover comprises at least one of aluminum or magnesium.

4. The replaceable seat belt buckle cover of claim 1, wherein the top cover comprises at least one top cover fastener hole for receiving the at least one fastener, and wherein the bottom cover comprises at least one bottom cover fastener hole corresponding to the at least one top cover fastener hole.

5. The replaceable seat belt buckle cover of claim 4, wherein the at least one top cover fastener hole comprises four fastener holes, each being situated in a corner of the top cover, and the at least one bottom cover fastener hole comprises four fastener holes, each being situated in a corner of the bottom cover.

6. A replaceable seat belt buckle cover, comprising:

a top cover, comprising:

a top wall comprising a first opening for providing access to a release of a seat belt buckle received within the replaceable seat belt buckle cover;

a first side wall and a second side wall extending substantially perpendicular from the top wall; and a back wall substantially perpendicular to the top wall, the first side wall, and the second side wall, the back wall comprising a second opening for receiving a seat belt therein, the seat belt mechanically coupled to the seat belt buckle; and a bottom cover having a top face that abuts the first side wall, the second side wall, and the back wall when the bottom cover is coupled to the top cover;

at least one fastener for coupling the top cover to the bottom cover;

wherein the first opening is of a sufficient size that a user can pass a finger through the first opening to access a seat belt buckle release using the finger, while the top cover is secured to the bottom cover;

wherein the bottom cover comprises at least one through hole for receiving the at least one fastener therein and the top cover comprises at least one hole therein corresponding to the at least one through hole; and wherein the at least one through hole comprises a first through hole which is disposed opposite from a second through hole.

7. The replaceable seat belt buckle cover of claim 6, wherein the top cover further comprises a front wall substantially perpendicular to the top wall, the first side wall and the second side wall and substantially parallel to the back wall.

8. The replaceable seat belt buckle cover of claim 7, wherein the front wall comprises:

a first shoulder substantially parallel to a second shoulder; and a connecting member extending from the first shoulder to the second shoulder.

9. The replaceable seat belt buckle cover of claim 6, wherein, when coupled, the top cover and the bottom cover do not contact the seat belt buckle to reduce damage thereto when forces are applied to the replaceable seat belt buckle cover.

10. The replaceable seat belt buckle cover of claim 6, wherein the top cover and the bottom cover comprise at least one chamfered edge or at least one filleted edge.

11. A replaceable seat belt buckle cover, comprising:

a top cover configured to at least partially enclose a seat belt buckle, the top cover comprising:

a first shoulder;

a second shoulder which is substantially parallel to the first shoulder and defining a gap therebetween;

a connecting member extending from the first shoulder to the second shoulder; and at least one opening for providing a seat belt wearer access to a seat belt buckle;

a bottom cover configured to at least partially enclose the seat belt buckle, the bottom cover comprising a top face abutting a bottom face of the top cover; and at least one connector for coupling the top cover to the bottom cover;

wherein the at least one opening is of a sufficient size that a user can pass a finger through the at least one opening to access the seat belt buckle release using a finger, while the top cover and the bottom cover are in connection with one another; and wherein the at least one opening comprises a first opening and a second opening located on opposing sides of the connecting member, the first opening providing access to a release of the seat belt buckle and the second opening providing access to a receiver of the seat belt buckle for insertion of a seat belt buckle tongue.

12. The replaceable seat belt buckle cover of claim 11, wherein the at least one connector comprises at least one of a fastener, an adhesive, or a magnet.

13. The replaceable seat belt buckle cover of claim 11, wherein the bottom cover is hingedly coupled to the top cover.

14. The replaceable seat belt buckle cover of claim 11, wherein the top cover comprises a back wall having the second opening for receiving a seat belt of the seat belt buckle.

* * * * *